United States Patent [19]

Cotton

[11] Patent Number: 4,477,982

[45] Date of Patent: Oct. 23, 1984

[54] MICROCONTROLLER-BASED DRYER CONTROL

[75] Inventor: Curran D. Cotton, Newton, Iowa

[73] Assignee: The Maytag Company, Newton, Iowa

[21] Appl. No.: 423,671

[22] Filed: Sep. 27, 1982

[51] Int. Cl.[3] ..... F26B 21/06

[52] U.S. Cl. ..... 34/48; 34/53; 34/55

[58] Field of Search ..... 34/48, 53, 55

[56] References Cited

U.S. PATENT DOCUMENTS

| | | | |
|---|---|---|---|
| 3,702,030 | 11/1972 | Janke | 34/33 |
| 3,710,138 | 1/1973 | Cotton | 307/118 |
| 3,758,959 | 9/1973 | Karklys | 34/45 |
| 3,762,064 | 10/1973 | Offutt | 34/45 |
| 4,385,452 | 5/1983 | Deschaaf et al. | 34/48 |

FOREIGN PATENT DOCUMENTS

| | | | |
|---|---|---|---|
| 3003982 | 8/1981 | Fed. Rep. of Germany | 34/55 |

*Primary Examiner*—Larry I. Schwartz
*Assistant Examiner*—David W. Westphal
*Attorney, Agent, or Firm*—Richard L. Ward

[57] ABSTRACT

A control is provided for a fabric drying machine and includes selection apparatus operable for initiating a fabric drying cycle having a dryness sensing operation. The control includes a microcontroller for controlling the fabric drying cycle as initiated by the selection apparatus. A power supply is provided for energizing the control and sensors are associated with the fabric drying machine for completing an electrical current path through wet fabrics or other conductive materials during the dryness sensing operation. Electrical circuitry interconnects the sensors and the microcontroller. The circuitry is operable for providing a series of input signals to the microcontroller upon completion of an electrical current path across the sensors and indicative of a dryness condition of the fabrics of less than a predetermined dryness and is further operable for differentiating between contact by wet fabrics and metallic objects. Counting apparatus is associated with the microcontroller for accumulating a count of the input signals, the microcontroller being responsive to at least a predetermined number of input signals in a predetermined sensing period for continuing the fabric drying cycle and repeating the predetermined sensing period and responsive to less than the predetermined number of input signals in the predetermined sensing period for initiating termination of the fabric drying cycle.

18 Claims, 5 Drawing Figures

MICROCONTROLLER-BASED DRYER CONTROL

BACKGROUND OF THE INVENTION

This invention relates generally to the field of control circuitry for appliances and more particularly to an electronic dryer control circuit for sensing the dryness of fabrics.

In the field of electronic dry controls for a fabric drying appliance a pair of spaced-apart electrodes have been utilized for sensing the electrical conductivity of fabrics in the fabric tumbling container. A number of control circuits have been shown for determining fabric dryness through sensing circuits which include resistance-capacitance timing circuits in conjunction with the spaced-apart electrodes and which are operable for terminating the drying operation at a preselected dryness condition.

While a resistance-capacitance timing circuit as used with spaced-apart dryer electrodes has been successfully used in the appliance industry for sensing fabric dryness, the availability of microcontrollers facilitates the elimination of the prior art resistance-capacitance circuitry and the use of simplified circuitry directly coupled to the dryer electrodes for providing an input signal to a microcontroller indicative of the dryness condition of the fabrics.

SUMMARY OF THE INVENTION

It is therefore an object of the instant invention to provide an improved fabric dryness sensing circuit.

It is a further object of the instant invention to eliminate the resistance-capacitance timing portion of a dryness sensing circuit.

It is a still further object of the instant invention to interface the fabric dryness sensing circuitry with a microcontroller.

It is yet another object of the instant invention to provide control circuitry which will differentiate between wet fabrics and metal objects across the spaced-apart electrodes.

Briefly, the instant invention achieves these objects in a control for a fabric drying machine. Selection apparatus is operable for initiating a fabric drying cycle including a dryness sensing operation. Control circuitry is provided which includes a microcontroller for controlling the fabric drying cycle as initiated by the selection apparatus. A power supply is operable for energizing the control circuitry. Sensors are engageable with wet fabrics for completing an electrical current path therethrough. Circuitry is provided which is in circuit with the sensors and the microcontroller, the circuitry being operable for providing a series of input signals to the microcontroller responsive to completion of the electrical current path and indicative of a dryness condition of the fabrics of less than a predetermined dryness. Counting apparatus is associated with the microcontroller for accumulating a count of the input signals. The microcontroller is operable for initiating termination of the fabric drying cycle when the series of input signals fail to accumulate to at least a predetermined number in a predetermined sensing time period.

Operation of the circuit and further objects and advantages thereof will become evident as the description proceeds and from an examination of the accompanying three sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

The invention disclosed herein is directed toward a microcontroller-based dryness sensing arrangement for a fabric drying appliance. As the fabric tumbling drum is rotated, the clothing or fabrics contained therein fall across spaced-apart dryer electrodes. Through appropriate sensing circuitry the microcontroller is programmed to detect when a current path is completed across the electrodes. The wet fabric detections or signals are accumulated for a predetermined time in a counter which is created through programmed software within the microcontroller and when the counter fails to accumulate a predetermined number of consecutive electrode or sensor hits in that predetermined time the fabrics are determined to be dry within the range of that cycle of operations. A portion of the control circuitry is operable for detecting a spurious sensor hit by a metallic object such as a zipper or a safety pin. The microcontroller terminology as utilized herein is to be interpreted as including microprocessors and dedicated chip controllers such as programmable logic arrays.

Figure 1:
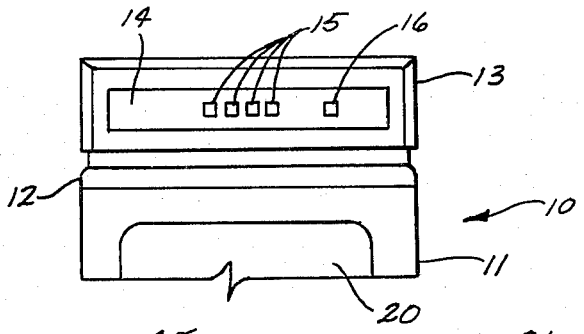
FIG. 1 is a partial front elevation view of a fabric drying appliance including a touch responsive control panel.

Referring now to the drawings and in particular to FIG. 1, there is shown a free-standing fabric drying appliance 10 having a cabinet 11 and a top cover 12. Extending upwardly from the top cover 12 is a control housing 13 for mounting various control members. The control housing 13 includes a control surface 14 having a plurality of cycle selection momentary switches 15 and a power-on switch pad 16 incorporated therein. The various momentary switches 15 are operable to closed postures for completing circuits to produce signals to a microcontroller as indicated by the numeral 19 in FIGS. 2 and 3. The cabinet 11 of the appliance 10 includes an access door 20 for providing access to the interior of the fabric tumbling drum (not shown) for loading and unloading fabrics to be dried.

Figure 2:
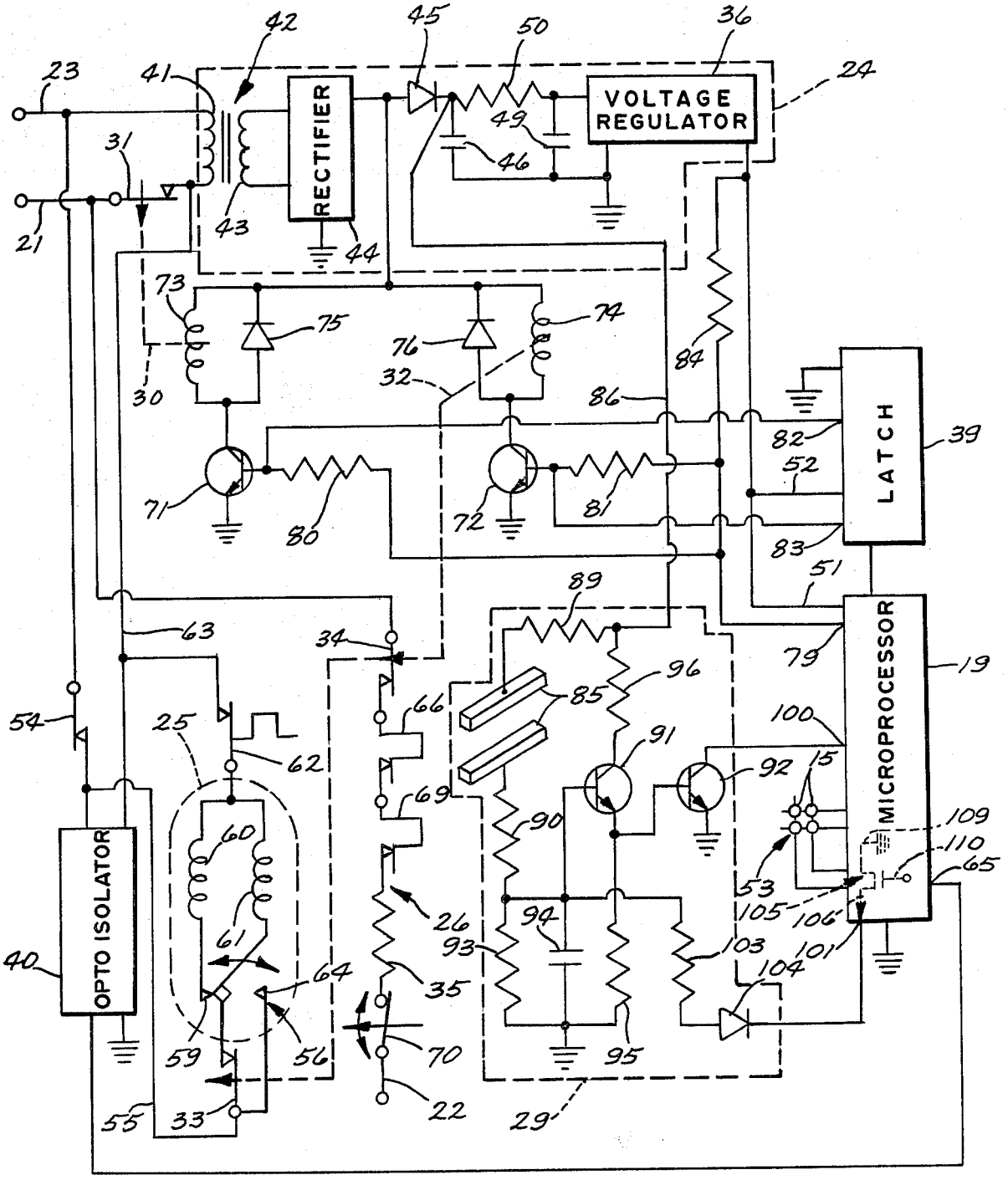
FIG. 2 is an electrical schematic circuit diagram for the appliance including the dryness sensing circuit.

The control circuitry of FIG. 2 includes three power supply conductors 21, 22 and 23 which are connectable with a three-wire 240 volt, alternating current power source. For purposes of explanation of FIG. 2, it will be assumed that the conductors 21 and 22 are connected with the power lines and that the neutral conductor 23 is connected to the earth grounded neutral line.

The control circuit of FIG. 2 is composed of a number of electrical circuit portions. Included is a power supply generally enclosed by broken line 24 and operable for supplying a plurality of voltages to operate various components. Also in this embodiment, a drive motor 25 is provided for rotating the fabric drying drum and an electrical heating circuit 26 is provided for heating the air used for drying fabrics within the fabric drying drum. Electronic dry control circuitry, which will be further described herein, is enclosed by the broken line 29 and is operable for effecting termination of various fabric drying cycles on the basis of the moisture content of the fabrics.

The control circuit of FIG. 2 further includes an on/of relay 30 having a switch 31 which is manually set and mechanically latched for powering the appliance 10 by depressing the power-on switch pad 16. The on/off relay 30 is actuated by a signal from the microcontroller 19 at the end of a cycle to terminate operation of the appliance 10 by effecting the opening of the switch 31. A motor/heater relay 32 is energized by a logic zero signal from the microcontroller 19 when the appliance 10 is initially energized to close a pair of switches 33 and 34 associated with the drive motor 25 and the heating circuit 26 respectively. The microcontroller 19 is programmed to output either a logic one or a logic zero signal to the various components. For purposes of explanation of FIG. 2 a logic zero can be considered to be essentially a circuit common condition and a logic one can be considered to be the output potential of the voltage regulator 36.

The control circuit of FIG. 2 further shows the National Semiconductor COPS 420/421 N-Channel microcontroller 19, a National Semiconductor MM5450 latch 39 and a General Instruments MCT opto isolator 40.

To energize the circuit of FIG. 2 for controlling the fabric drying appliance 10 shown in FIG. 1, the switch 31 associated with on/off relay 30 is manually set and mechanically latched by pressing the power-on switch pad 16 shown in FIG. 1. Depressing the power-on switch pad 16 will close the contacts of the switch 31 and will supply 120 volts RMS to the primary winding 41 of the power supply transformer 42.

The power supply transformer 42 develops 18 volts RMS across the secondary winding 43 creating a 25.5 volt peak alternating current potential at the input of a full wave bridge rectifier 44. The full wave bridge rectifier 44 then rectifies the secondary current to create a pulsating direct current supply. The diode 45 and the pair of capacitors 46 and 49 provide a filtered direct current supply as an input to the voltage regulator 36. The resistor 50 limits the voltage at the input to the voltage regulator 36. The output of the voltage regulator 36 provides a regulated 5 volts DC for powering the microcontroller 19 and the MM5450 latch 39 through conductors 51 and 52.

The crossed lines 53 adjacent the microcontroller 19 represent a portion of a keyboard matrix. The momentary switches 15 shown in FIG. 1 and schematically in FIGS. 2 and 3 directly input information to the microcontroller 19 relative to various fabric drying cycles and/or cycle options. Each momentary switch 15 is connected across a row and column of the keyboard matrix to input a specific digital code to the microcontroller 19.

The energizing circuit for the drive motor 25 operates on 120 volts between the neutral conductor 23 and the power supply conductor 21 through a circuit including door switch 54, conductor 55, first motor/heater switch 33, centrifugal switch 56 made to the normally closed contact 59 within the drive motor 25, start and run windings 60 and 61, thermal protector 62, conductor 63 and manually operable relay switch 31.

Until the drive motor 25 rotates at a predetermined speed the start and run windings 60 and 61 are both energized through the centrifugal switch 56 made to the normally closed contact 59, but upon operation of the centrifugal switch 56 to the normally open contact 64 the start winding 60 is disconnected from the circuit. After initial energization of the drive motor 25 and operation of the centrifugal switch 56 to the normally open contact 64, the circuit for maintaining energization of the drive motor 25 will extend from the neutral conductor 23, through the door switch 54, through the parallel combination of the normally open contact 64 of the centrifugal switch 56 and the first motor/heater relay switch 33, through the run winding 61, through the thermal protector 62, conductor 63, and the manually operable relay switch 31 to conductor 21.

An opto isolator 40 is provided between the door switch 54 and terminal 65 of the microcontroller 19. The microcontroller 19 continually monitors the condition of the door switch 54 through the opto isolator 40. If the door switch 54 is found to be open, the microcontroller 19 will output a signal through the latch 39 to deenergize the relay 30. Deenergizing the relay 30 will open relay switch 31 and prevent the drive motor 25 from being reenergized upon closing the access door 20. It is thus necessary to also reclose the appropriate cycle selection switch 15 in a push-to-start manner after reclosing the access door 20 before the drive motor 25 will be restarted.

As further indicated in FIG. 2, the heater circuit 26 for the fabric drying appliance 10 extends between power supply conductors 21 and 22 and operates on 240 volts. The heater circuit includes, in series connection from conductor 21 to conductor 22, the second motor/heater relay switch 34 which is closed when the appliance 10 is first energized, a pair of temperature limiting thermostats 66 and 69, an electric heater 35 and a second normally open centrifugal switch 70 located physically within the drive motor 25.

The transistors 71 and 72 provide an electrical interface with the relay solenoids 73 and 74. A logic zero signal is transmitted from the microcontroller 19 to the latch 39 which will output a logic one signal to either transistor 71 or 72, the transistor 71 or 72 will conduct and effect energization of the relay solenoid 73 or 74. The pair of diodes 75 and 76, in parallel with the relay solenoids 73 and 74 provide snubber paths around the relay solenoids 73 and 74 to allow the solenoid fields to collapse upon termination of operation without the appearance of voltage spikes on the collectors of transistors 71 and 72.

The base leads of transistors 71 and 72 are connected to terminal 79 of the microcontroller 19 through resistor 80 and resistor 81 respectively and are also connected to terminals 82 and 83 of the MM5450 latch 39. The dual connection of the transistors 71 and 72 with the microcontroller 19 and the latch 39 exist for initial energization purposes only. Once the appliance 10 has been powered by manually closing the normally open power-on switch 31, the voltage regulator 36 provides a 5 volt potential to both the microcontroller 19 and the MM5450 latch 39. Upon initial energization, it is the characteristic of the microcontroller 19 to cause terminal 79 to become logic zero. It is further the characteristic of the MM5450 latch 39 upon initial energization to cause terminals 82 and 83 to be a logic one. The connection at terminal 79 ensures that the transistors 71 and 72 are held in an off condition until the microcontroller 19 can initialize the condition of terminals 82 and 83 of the MM5450 latch 39 to a logic zero. Shortly after initial energization under program control, the microcontroller 19 programs the MM5450 latch 39 in such a manner that terminals 82 and 83 also become a logic zero. Once this is accomplished, terminal 79 of the microcontroller 19 is configured as a logic one. If the junctions between resistors 80 and 84 and resistors 81 and 84 were not connected to the logic zero terminal 79 of the microcontroller 19, during initial energization the 5 volt output of the voltage regulator 36 would cause the transistors 71 and 72 to conduct by providing base current equivalent to a logic one condition through resistors 80 and 81, respectively. This transient circuit condition would attempt to cause the relay solenoid 73 to unlatch or reset the normally open switch 31 being held in the closed position to power the appliance 10 and would also attempt to energize solenoid 74 to close the first and second relay switches 33 and 34.

Shown pictorally in FIG. 2 as part of the electronic dry control circuitry 29 are a pair of moisture sensing sensors or electrodes 85 which are secured to the inside of the front bulkhead of the appliance 10 in such a manner as to be electrically isolated from the bulkhead and from each other for contact with conductive materials such as wet fabrics or metallic objects as they are tumbled during a drying cycle. In the preferred embodiment of FIG. 2, the electronic dry control or fabric dryness sensing circuit enclosed by the broken line 29 is provided with DC power from the power supply 24 through conductor 86.

In addition to the sensors or electrodes 85, the fabric dryness sensing circuit 29 includes resistors 89 and 90 in series with the electrodes 85 to provide current limit protection in case of a grounded electrode 85 or a static discharge. A pair of transistors 91 and 92 are connected in a cascading arrangement for providing a relatively high gain or amplification while maintaining a low voltage drop across the collector-emitter junction of transistor 92 when conducting. The parallel connected resistor 93 and capacitor 94 serve as a static filter with the capacitor 94 smoothing out voltage spikes and the resistor 93 being operable for discharging the capacitor 94. Resistor 95 is operable for preventing spurious turn-on of the transistor 91 and resistor 96 serves as a current limiting resistance for the transistor gain circuit.

Also shown as part of the circuitry of FIG. 2 and extending from the junction of the base of transistor 91 and resistors 90 and 93 to terminal 101 of the microcontroller 19 is a circuit portion including, in series connection, a resistor 103 and a diode 104. This circuit portion also includes a field effect transistor 105 located within the microcontroller 19. The drain electrode 106 of transistor 105 is connected to terminal 101 of the microcontroller 19, the source electrode 109 of transistor 105 is connected to common or ground and the gate electrode 110 of transistor 105 is connected to a positive voltage potential such as 5 volts DC under control of the microcontroller 19. The operation of this circuit portion with the total fabric dryness sensing circuit 29 and as controlled by the microcontroller 19 will be discussed herein.

As wet fabrics are tumbled and fall across the electrodes 85 they initially exhibit a relatively low electrical resistance and an electrical current path is formed across the pair of electrodes 85. In certain clothing loads the items to be dried may contain metallic objects such as a zipper or a safety pin which also have a low electrical resistance and which will also form an electrical current path across the pair of electrodes 85. It is desirable for the fabric dryness sensing control 29 to be able to differentiate between actual wet fabrics bridging the electrodes 85 during tumbling and contacts or hits by metallic objects. This differentiation is desirable so that as the fabrics become dry, random contacts or hits by metallic objects will not be falsely interpreted as contacts by wet fabrics and cause the fabric dryness sensing circuit 29 to unnecessarily extend the drying operation.

When conductive materials such as wet fabrics or metallic objects are not bridging the electrodes 85 and thus are not providing an electrical current path the transistors 91 and 92 and the field effect transistor 105 within the microcontroller 19 will all be in a non-conducting state. In this non-conducting state terminal 100 of the microcontroller 19 is configured at a 5 volt DC potential or a logic one condition by the microcontroller 19. The microcontroller 19 is programmed to recognize this condition as an indication that the electrodes 85 are clear.

When either wet fabrics or metallic objects contact the electrodes 85 during tumbling, transistor 91 will be biased to a conductive condition which will also bias transistor 92 to a conductive condition. When transistor 92 conducts, the input at microcontroller terminal 100 will be pulled from a 5 volt DC potential or a logic one state to approximately a ½ volt potential or a logic zero state. The microcontroller 19 is programmed to recognize this state as an indication that conductive material such as wet fabrics or metallic objects have bridged the electrodes 85.

Once it has been determined that conductive material such as wet fabrics or metallic objects have bridged the electrodes 85, the gate 110 of the field effect transistor 105 will be configured to a conductive condition by the microcontroller 19. Prior to this configuration, the field effect transistor 105 did not conduct and was not a factor in the circuit. When the transistor 105 conducts it will significantly effect the base current of transistor 91. As transistor 105 conducts, a significant portion of the current flowing through resistor 90 will flow through resistor 103, diode 104, and the drain-source junction 106–109 of transistor 105. If the conductive material across the electrodes 85 were a metallic object and not wet fabrics, transistor 91 would continue conducting since the relatively low resistance of the metallic object would provide enough current flow through resistors 90 and 103 and the transistor 105 to cause a voltage drop at the junction of resistors 90, 93, 103 and the base of transistor 91 of sufficient magnitude for transistor 91 to remain in conduction.

If the conductive material across the electrodes 85 were wet fabrics and not a metallic object, the conduction of transistor 105 would cause a relatively low voltage potential at the base of transistor 91. This potential would be low enough that transistor 91 would not conduct and therefore transistor 92 would not conduct and terminal 100 of the microcontroller 19 would switch from the low voltage level to the relatively high 5 volt potential. This switching of the voltage level across the collector-emitter junction of transistor 92 indicates to the microcontroller 19 that the conductive material across the electrodes 85 is of the resistivity level of wet fabrics rather than a metallic object.

Stated differently, the dry control circuitry 29 checks or differentiates between wet fabrics and metallic objects in the following manner. The sensors or electrodes 85 are monitored approximately each millisecond for a high resistance condition. If relatively high resistance is found to exist, the microcontroller 19 changes the base current of transistor 91 by configuring the field effect transistor 105 to a conductive condition. The sensors or electrodes 85 are now monitored for relatively low resistance. Wet fabrics respond to only the high resistance check while metallic objects will respond to both. Thus, the microcontroller 19 differentiates between wet fabrics and metallic objects.

Figure 3:
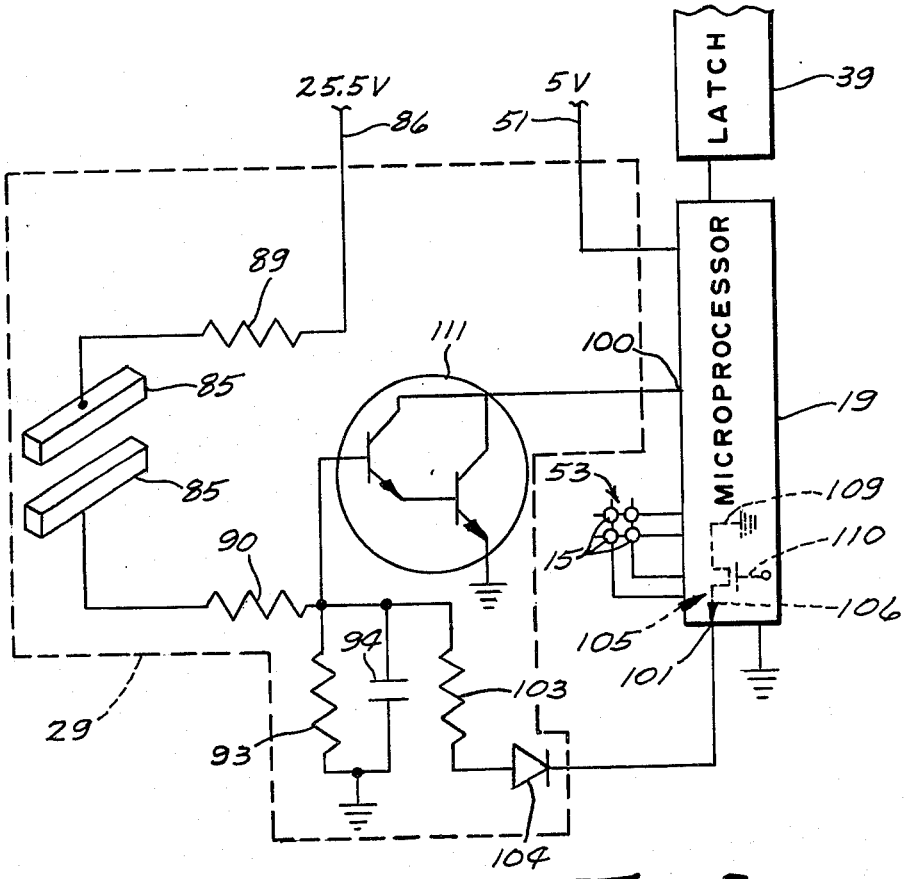
FIG. 3 is a partial schematic circuit diagram showing an alternate embodiment of the dryness sensing circuit.

The partial circuit of FIG. 3 depicts an alternate embodiment of the fabric dryness sensing circuit 29 of FIG. 2. This embodiment of the dryness sensing circuit 29 utilizes a single Darlington transistor 111 in place of the cascaded transistors 91 and 92 used in the embodiment of FIG. 2. A Darlington transistor 111 has a broad band of sensitivity as compared to the cascaded transistors 91 and 92. Because of this broad sensitivity band, the Darlington transistor 111 and the microcontroller 19 should be chosen so that the Darlington transistor 111 will always be able to pull the microcontroller terminal 100 to a low voltage condition.

Figure 4:
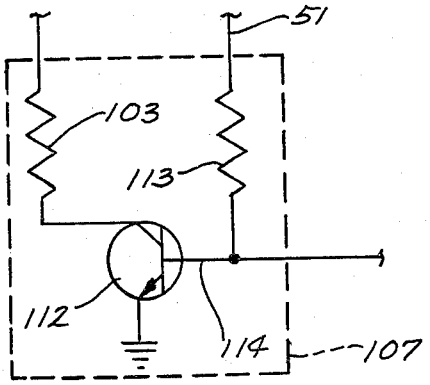
FIG. 4 is a partial schematic circuit diagram showing an alternate embodiment of a portion of the dryness sensing circuit.

The partial schematic circuit of FIG. 4 shows circuitry 107 which is an alternate embodiment for the circuitry of FIG. 2 which includes resistor 103, diode 104 and internal field effect transistor 105. In this circuitry 107, the transistor 112 is located outside the body of the microcontroller 19, the diode 104 is eliminated and a pull-up resistor 113 connected to the 5 volt output of the voltage regulator 36 is added. The base 114 of the transistor 112 is connected to terminal 101 of the microcontroller 19 and the circuit functions in the same manner as the circuitry of FIG. 2 to change the base current of transistor 91 during the electrode checks. It is noted that if a manufacturer were willing to pay the expense of making a custom microcontroller chip, all of the transistor and diode hardware could be made part of the chip.

Figure 5:
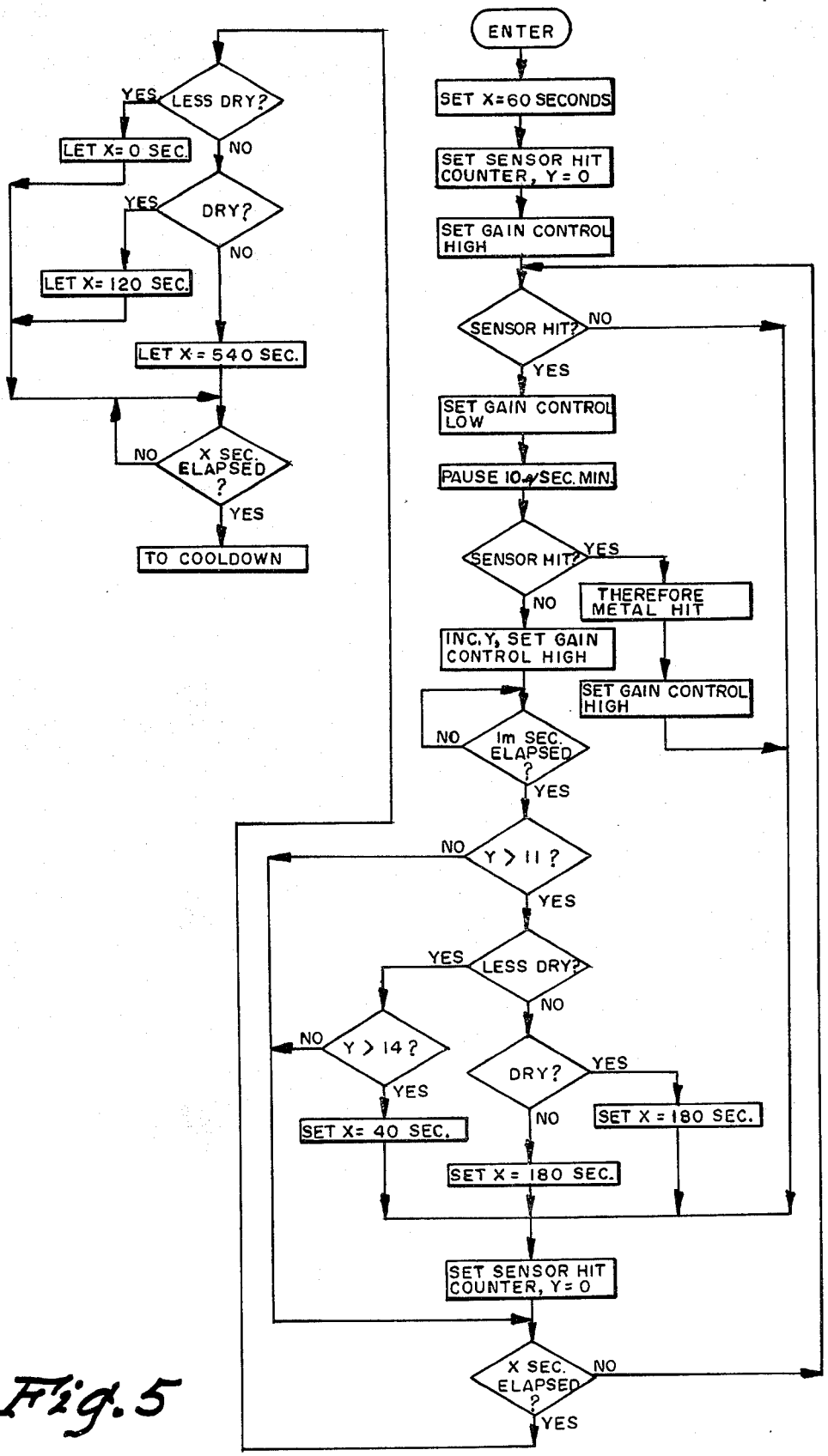
FIG. 5 is a flow chart corresponding to a portion of a microcontroller program.

Turning now to FIG. 5, there is shown a flow chart corresponding to that part of the microcontroller program which monitors the electrodes or sensors 85 for the presence of conductive materials. As previously discussed, the sensors 85 are monitored approximately once each millisecond. It is to be understood that the information and programming steps flow charted herein are valid for a particular embodiment of the invention and that numerous variations of the flow charting and programming could be utilized to obtain similar results. Initially, a first counter within the microcontroller 19 is arbitrarily labeled "X" and is set to X=60 seconds. This counter is initially set to 60 seconds so that if the appliance 10 is started without a fabric load, operation will terminate after 60 seconds. Next, a second counter labeled "Y" for recording electrode or sensor hits by conductive materials such as wet fabrics or metallic objects is set to zero. The gain control for the dryness sensing circuit 29 is set high by configuring terminal 101 of the microcontroller 19 to a positive 5 volt potential At the first sensor hit interrogation, the electrodes or sensors 85 are checked for a hit or the presence of conductive material such as wet fabrics or metallic objects. If there is no hit, the second counter "Y" is maintained at zero and a check is made to see if "X" seconds have elapsed. If "X" seconds have not elapsed the control will loop back to the entry point of the first interrogation. If there is no load to be dried, this loop will continue until X=60 seconds have elapsed and then the control will proceed to terminate operation of the appliance 10.

If, at the first interrogation, a sensor hit were detected, the gain control would be set low. This is achieved by the microcontroller 19 configuring the internal field effect transistor 105 to a conductive posture which will reduce the base current to transistor 91. At this point, the program will pause for a minimum of 10 microseconds and then the electrodes or sensors 85 will be interrogated a second time for a conductive condition. If a conductive condition is now detected it is a metal hit since, as previously discussed, transistors 91 and 92 are still conducting and terminal 100 is in a low voltage or logic zero condition. The microcontroller 19 has been programmed to ignore the possible periodic hits by metallic objects such as zippers or safety pins. Therefore, the gain control is again configured high by configuring transistor 105 to a non-conductive posture and the second counter "Y" is set to Y=0. A check is made to determine if the initial 60 seconds have elapsed, and if not, the control will loop back to the first sensor hit interrogation.

If, at the second sensor hit interrogation, a hit is not indicated, wet fabrics are present (as opposed to metallic objects), the second counter "Y" is incremented by one and the gain control is reset to high by configuring transistor 105 to a non-conductive posture. An interrogation is made to determine if approximately one millisecond has elapsed since the condition of the sensors 85 was last monitored. If not, the control will loop until that time has elapsed. If approximately one millisecond has elapsed, an interrogation is made to determine if the second counter "Y" is greater than 11 which is indicative of the number of consecutive wet fabric determinations that must be made in this embodiment of the invention for continuation of a "dry" cycle selection. When the "Y" counter accumulates 11 or fewer consecutive wet fabric determinations in the 180 second predetermined interval of time the fabrics will be considered dry within the range of the "dry" cycle. The number of consecutive wet fabric determinations require for a particular cycle have been chosen on an experimental basis for this particular embodiment and other figures could be used dependent on the criteria for dryness.

If "Y" is greater than 11, the program will go on to determine which dry cycle has been selected. As previously mentioned, a minimum number of consecutive hits by wet fabrics in a predetermined time must be recorded for each of the dryness settings, more than 11 for "dry" and more than 14 for "less dry" to continue the drying operation. If, for example, the "less dry" selection had been made, an interrogation is made to determine if "Y" is greater than 14. If "Y" is greater than 14, the first counter "X" is set to 40 seconds, the second counter "Y" is set to zero and the number of sensor hits in the predetermined time of X=40 seconds will be determined. The program proceeds to termination of appliance operation when "Y" or the number of consecutive wet fabric determinations is 14 or fewer in the predetermined amount of time.

If "less dry" were not selected, an interrogation is made to determine if "dry" were selected. If "dry" had been selected and the "Y" counter is greater than 11, the first counter "X" is set to 180 seconds and the second counter "Y" is set to 0. In the same manner as for the previous selection the program will now check the number of sensor hits in the predetermined time of 180 seconds. Once 11 or fewer consecutive sensor hits are accumulated in the 180 second time period, the fabrics will be considered dry and the program will proceed to termination of appliance operation.

In the program operation as described herein, once the "Y" counter fails to accumulate the required number of consecutive sensor hits in the predetermined amount of time for the selected cycle, the program proceeds to the cycle termination portion. In this portion of the program (shown on the left side of FIG. 5), if "less dry" had been selected, the "X" counter is set to 0 and the program will proceed to an "X" seconds elapsed interrogation and from there to a "cool down" operation. If "dry" had been selected, the "X" counter is set to 120 seconds and the program proceeds to the above mentioned "X" seconds elapsed interrogation. The program will loop until the "X" seconds have elapsed before proceeding to the "cool down" operation. If "dry" had not been selected, the "X" counter would be set to 540 seconds thereby defaulting to a "more dry" situation and the program will proceed to the "cool down" operation after this time has elapsed.

After the dryer has operated with heat to dry the fabrics, the "cool down" operation is initiated. During this operation the drive motor 25 will remain energized for a predetermined period of time through the microcontroller 19 for tumbling the fabrics and the heater 26 will be deenergized allowing the fabrics to cool.

After the "cool down" operation, the microcontroller 19 causes terminal 82 of the MM5450 latch 39 to become a logic one. This places a positive potential at the base of transistor 71 causing base current to flow and forcing it into conduction for energizing solenoid 73. This energization allows the switch 31 to reset to the normally open position thereby terminating operation of the appliance 10.

It can thus be seen that the instant invention provides an improved fabric dryness sensing circuit for a fabric drying appliance controlled by a microcontroller. The instant invention provides a fabric dryness sensing circuit wherein transistor circuitry eliminates the resistor-capacitor timing circuitry and neon lamp as previously utilized in the industry. The instant invention further provides for directly interconnecting the fabric dryness sensing circuit with the microcontroller. It is to be understood that while the particular embodiment of the invention disclosed herein detects and counts consecutive sensor hits by tumbling wet fabrics, it is possible to program the microcontroller to check for any sequence or order of sensor hits desired and the scope of invention is therefore not to be so limited.

In the drawings and specification, there has been set forth a preferred embodiment of the invention and although specific terms are employed these are used in a generic and descriptive sense only and not for purposes of limitation. Changes in form and the proportion of parts as well as the substitution of equivalents are contemplated as circumstances may suggest or render expedient without departing from the spirit or scope of the invention as further defined in the following claims.

I claim:

1. A control for a fabric drying machine, comprising: selection means operable for initiating a fabric drying cycle including a dryness sensing operation; control means including microcontroller means having a plurality of terminals and operable for controlling said fabric drying cycle as initiated by said selection means; power supply means for energizing said control means; sensor means engageable with wet fabrics for completing an electrical current path therethrough; circuit means in circuit with said sensor means and said microcontroller means, said circuit means being operable for changing one of said terminals from a first to a second voltage state responsive to completion of said electrical current path and indicative of a dryness condition of said fabrics of less than a predetermined dryness; and counting means associated with said microcontroller means for accumulating a count of said changes in voltage state, said microcontroller means operable for initiating termination of said fabric drying cycle when said changes in voltage state fail to accumulate to at least a predetermined number in a predetermined sensing time period.

2. A control as defined in claim 1 wherein each change in voltage state is responsive to a periodic interrogation signal received at said sensor means and the absence of a change in voltage state responsive to said interrogation signal indicates the absence of said electrical current path and thus a dryness condition of said fabrics of at least as dry as said predetermined dryness.

3. A control for a fabric drying machine, comprising: selection means operable for initiating a fabric drying cycle including a dryness sensing operation; control means including microcontroller means having a plurality of terminals and operable for controlling said fabric drying cycle as initiated by said selection means; power supply means for energizing said control means; sensor means engageable with fabrics or other more highly conductive material for completing an electrical current path during said fabric drying cycle; circuit means in circuit with said sensor means and said microcontroller means, said circuit means being operable for changing one of said terminals from a first to a second voltage state indicative of a dryness condition of said fabrics of less than a predetermined dryness; and counting means associated with said microcontroller means for accumulating a count of said changes in voltage state, said microcontroller means operable for initiating termination of said fabric drying cycle when said counting means fails to accumulate a predetermined number of changes in voltage state in a predetermined time.

4. A control as defined in claim 3 wherein said circuit means includes a circuit portion for maintaining said terminal at said second voltage state if the resistance across said sensor means is substantially less than that of wet fabrics and wherein said microcontroller means is operable for detecting that said terminal has not changed voltage states in a predetermined time frame whereby the presence of wet fabrics may be distinguished from said more highly conductive material.

5. A control for a fabric drying machine, comprising: selection means operable for initiating a fabric drying cycle including a dryness sensing operation; control means including microcontroller means having a plurality of terminals and operable for controlling said fabric drying cycle as initiated by said selection means; power supply means for energizing said control means; sensor means engageable with wet fabrics or other more highly conductive material associated with said fabrics for completing an electrical current path therethrough; circuit means in circuit with said sensor means and said microcontroller means, said circuit means being operable for changing one of said terminals from a first to a second voltage state responsive to completion of said electrical current path and indicative of a dryness condition of said fabrics of less than a predetermined dryness; and counting means associated with said microcontroller means for accumulating a count of said changes in voltage state, said microcontroller means being responsive to at least a predetermined number of changes in voltage state in a predetermined sensing period for continuing said fabric drying cycle and repeating said predetermined sensing period and responsive to less than said predetermined number of changes in voltage state in said predetermined sensing period for initiating termination of said fabric drying cycle.

6. A control as defined in claim 5 wherein said circuit means includes a first circuit portion and a second circuit portion and wherein said first circuit portion is operable for switching said terminal of said microcontroller means from said first to said second voltage state responsive to completion of a relatively high resistance electrical current path across said sensor means upon engaging said wet fabrics or said other more highly conductive material and said second circuit portion is operable for maintaining said second voltage state responsive to completion of a relatively low resistance electrical current path across said sensor means upon engagement with said more highly conductive material and wherein said microcontroller means is further operable for detecting that said terminal has not changed voltage states in a predetermined time frame to effectively distinguish between the presence of wet fabrics from the presence of said more highly conductive material

7. A control for a fabric drying machine, comprising: selection means operable for initiating a fabric drying cycle including a dryness sensing operation; control means including microcontroller means for controlling said fabric drying cycle as initiated by said selection means; power supply means for energizing said control means; sensor means engageable with wet fabrics or other more highly conductive material associated with said fabrics for completing an electrical current path therethrough; circuit means connected with said sensor means and said microcontroller means, said circuit means being alternatingly operable in a first mode for providing a first signal to said microcontroller means responsive to completion of a relatively high resistance electrical current path across said sensor means and in a second mode for providing a second input signal to said microcontroller means responsive to completion of a relatively low resistance electrical current path across said sensor means, said microcontroller means being operable to receive and distinguish between said first and second input signals with a first input signal followed by a second input signal indicating the presence of said more highly conductive material across said sensing means and a first input signal followed by the absence of said second input signal indicating the presence of wet fabrics across said sensing means; and counting means associated with said microcontroller means for accumulating a count of said wet-fabric-indicating first input signals, said microcontroller means operable for initiating the termination of said fabric drying cycle responsive to receipt of less than a predetermined number of wet-fabric-indicating first input signals in a predetermined time period.

8. A control for a fabric drying machine, comprising: selection means operable for initiating a fabric drying cycle including a dryness sensing operation; control means including microcontroller means for controlling said fabric drying cycle as initiated by said selection means; power supply means for energizing said control means; sensor means engageable with fabrics or other more highly conductive material for completing an electrical current path therethrough during said fabric drying cycle; circuit means including transistor means in circuit with said sensor means and said microcontroller means, said transistor means being operable for providing an input signal to said microcontroller means upon completion of said electrical current path across said sensor means, and circuit means further including means controlled by said microcontroller means for changing the current flow to said transistor means to alter operation thereof dependent on the resistance of said fabrics or other more highly conductive material completing said current path; and counting means associated with said microcontroller means for accumulating a count of said input signals corresponding to said fabric drying cycle, said microcontroller means operable for initiating termination of said fabric drying cycle upon failure of said counting means to accumulate a predetermined number of input signals in a predetermined time.

9. A control as defined in claim 8 wherein said transistor means includes a pair of low gain transistors arranged in a cascading manner.

10. A control as defined in claim 8 wherein said transistor means includes a Darlington transistor.

11. A control for a fabric drying machine, comprising: selection means operable for initiating a fabric drying cycle including a dryness sensing operation; control means including microcontroller means for controlling said fabric drying cycle as initiated by said selection means; power supply means for energizing said control means; sensor means associated with said fabric drying machine and engageable with conductive material such as wet fabrics for completing an electrical current path through said conductive material during said fabric drying cycle; circuit means including a pair of low gain transistors in circuit with said sensor means from a first to a second voltage state, said microcontroller means and said microcontroller means, said transistors being operable for switching a terminal associated with said microcontroller means from a first to a second voltage state, said microcontroller means programmed to recognize this change in voltage state as one of a conductive material engaging with said sensor means; and counting means associated with said microcontroller means for accumulating a count of said changes in voltage state, said microcontroller means operable for initiating termination of said fabric drying cycle when said counting means fails to accumulate a predetermined number of changes in voltage state in a predetermined time.

12. A control as defined in claim 11 and further including circuit means operable for differentiating between contact of said sensor means by wet fabrics or by metallic objects and including a portion activated by said microcontroller means upon the switching of said terminal to said second voltage state for changing the current flow to said pair of transistors so that said pair of transistors will be non-conductive when the resistance of wet fabrics is engaging with said sensor means.

13. A control as defined in claim 12 wherein said portion of said circuit means actuated by said microcontroller means includes a transistor for effecting said change in current flow.

14. A control for a fabric drying machine, comprising: selection means operable for initiating a fabric drying cycle including a dryness sensing operation; control means including microcontroller means for controlling said fabric drying cycle as initiated by said selection means; power supply means for energizing said control means; sensor means associated with said fabric drying machine and engageable with conductive materials such as wet fabrics for completing an electrical current path therethrough during said fabric drying cycle; circuit means including a Darlington transistor in circuit with said sensor means and said microcontroller means, said Darlington transistor being operable for switching a terminal associated with said microcontroller means from a first to a second voltage state, said microcontroller means programmed to recognize this change in voltage state as one of a conductive material engaging with said sensor means; and counting means associated with said microcontroller means for accumulating a count of said changes in voltage state, said microcontroller means operable for terminating said fabric drying cycle when said counting means fails to accumulate a predetermined number of changes in voltage state in a predetermined time.

15. A control as defined in claim 14 and further including circuit means operable for differentiating between contact of said sensor means by wet fabrics or by metallic objects and including transistor means activated by said microcontroller means upon the switching of said terminal to said second voltage state for changing the current flow to said Darlington transistor so that said Darlington transistor will be non-conductive when the resistance of wet fabrics is engaging with said sensor means.

16. A control for a fabric drying machine, comprising: selection means operable for initiating a fabric drying cycle including a dryness sensing operation; control means including microcontroller means for controlling said fabric drying cycle as initiated by said selection means; power supply means for energizing said control means; sensor means associated with said fabric drying machine and engageable with wet fabrics or other conductive material for completing an electrical current path therethrough during said fabric drying cycle; circuit means including a pair of low gain transistors in circuit with said sensor means and said microcontroller means, said transistors being operable for providing an input signal to said microcontroller means upon completion of said electrical current path across said sensor means by switching a terminal associated with said microcontroller means from a first to a second voltage state, said circuit means further including means for differentiating between contact by wet fabrics or metallic objects with said sensor means, said means for differentiating actuated by said microcontroller means upon provision of said input signal for changing the current flow to said transistors to render said transistors non-conductive if the resistance of wet fabrics is engaging said sensor means; and counting means associated with said microcontroller means for accumulating a predetermined number of consecutive wet fabric input signals in a predetermined period of a particular fabric drying cycle, said microcontroller means operable for initiating termination of said fabric drying cycle when said counting means fails to accumulate said predetermined number of consecutive input signals in a predetermined time period.

17. A control for a fabric drying machine, comprising: selection means operable for initiating a fabric drying cycle including a dryness sensing operation; control means including microcontroller means for controlling said fabric drying cycle as initiated by said selection means; power supply means for energizing said control means; sensor means engageable with fabrics or other more highly conductive material for completing an electrical circuit path during said fabric drying cycle; circuit means in circuit with said sensor means and said microcontroller means, said circuit means operable for providing a first input signal to said microcontroller means indicative of a dryness condition of said fabrics of less than a predetermined dryness, said circuit means further including a circuit portion for generating a second input signal if the resistance across said sensor means is substantially less than that of wet fabrics and wherein said microcontroller means is operable to receive and distinguish between the first and second input signals whereby the presence of wet fabrics may be distinguished from said more highly conductive material; and counting means associated with said microcontroller means for accumulating a count of said first input signals, said microcontroller means operable for initiating termination of said fabric drying cycle when said counting means fails to accumulate a predetermined number of said first input signals in a predetermined time.

18. A control for a fabric drying machine, comprising: selection means operable for initiating a fabric drying cycle including a dryness sensing operation; control means including microcontroller means for controlling said fabric drying cycle as initiated by said selection means; power supply means for energizing said control means; sensor means engageable with wet fabrics or other more highly conductive material associated with said fabrics for completing an electrical current path therethrough; circuit means in circuit with said sensor means and said microcontroller means, said circuit means being operable for providing a series of input signals to said microcontroller means responsive to completion of said electrical current path and indicative of a dryness condition of said fabrics of less than a predetermined dryness, said circuit means for providing said input signals further including a first circuit portion and a second circuit portion and wherein said first and second circuit portions are alternatingly operable for providing a first signal to said microcontroller means responsive to completion of a relatively high resistance electrical current path across said sensor means upon engaging said wet fabric or said other more highly conductive material and a second signal to said microcontroller means responsive to completion of a relatively low resistance electrical current path across said sensor means upon engagement with said more highly conductive material and wherein said microcontroller means is further operable to receive and distinguish between said first and second input signals to effectively distinguish between the presence of wet fabrics from the presence of said highly conductive material; and counting means associated with said microcontroller means for accumulating a count of said first input signals, said microcontroller means being responsive to at least a predetermined number of said first input signals in a predetermined sensing period for continuing said fabric drying cycle and repeating said predetermined sensing period and responsive to less than said predetermined number of said first input signals in said predetermined sensing period for initiating termination of said fabric drying cycle.

* * * * *

UNITED STATES PATENT AND TRADEMARK OFFICE

CERTIFICATE OF CORRECTION

PATENT NO. : 4,477,982

DATED : October 23, 1984

INVENTOR(S) : Curran D. Cotton

It is certified that error appears in the above-identified patent and that said Letters Patent are hereby corrected as shown below:

| | |
|---|---|
| Col. 3, line 9 | "on/of" should be -- on/off -- |
| Col. 8, line 41 | "require" should be -- required -- |
| Col. 12, lines 36 and 37 | "from a first to a second voltage state, said microcontroller means" (first occurrence) should be deleted. |

Signed and Sealed this

*Eleventh* Day of *June 1985*

[SEAL]

*Attest:*

DONALD J. QUIGG

*Attesting Officer*

*Acting Commissioner of Patents and Trademarks*